United States Patent [19]

Vena

[11] 3,987,295

[45] Oct. 19, 1976

[54] AUTOMATICALLY CLEANED TRAFFIC LIGHT

[75] Inventor: Andrew Vena, Philadelphia, Pa.

[73] Assignee: Lawrence Peska Associates, Inc., New York, N.Y. ; a part interest

[22] Filed: Oct. 21, 1975

[21] Appl. No.: 624,481

[52] U.S. Cl. ..... 240/11; 15/250 R; 134/201; 240/7.1 R; 240/22; 240/46.53; 240/47; 340/383

[51] Int. Cl.[2] ..... F21L 7/00

[58] Field of Search ..... 240/1 R, 7.1 R, 22, 240/46.53, 47, 11; 15/250, 1, 250.01; 52/11, 16, 171, 97; 340/22, 84, 383; 134/201; 296/154; 239/284; 137/312; D10/114, 115

[56] References Cited

UNITED STATES PATENTS

| | | | |
|---|---|---|---|
| 150,016 | 4/1874 | Fuller | 52/171 |
| 1,934,998 | 11/1933 | Stahlknecht | 240/47 X |
| 3,469,088 | 9/1969 | Coleman et al. | 240/7.1 R |

FOREIGN PATENTS OR APPLICATIONS

| | | | |
|---|---|---|---|
| 2,125,259 | 12/1971 | Germany | 239/284 |

*Primary Examiner*—John Gonzales

[57] ABSTRACT

A traffic signal signal lamp assembly has an upper lens and a lower lens bordered by ends of first and second cylindrical hoods, respectively. The first hood is connected to a first trough having an outlet port which extends through the first hood whereby rain water in the first trough flows through the outlet port over the upper lens. Additionally, the first hood has a drain hole above a second trough, similar to the first trough, having an outlet port which extends through the second hood whereby the rain water flows over the lower lens.

2 Claims, 2 Drawing Figures

AUTOMATICALLY CLEANED TRAFFIC LIGHT

BACKGROUND OF THE INVENTION

1. Field of the Invention

This invention relates to lighting and more particularly to traffic signal lamps.

2. Description of the Prior Art

It is well known that when a lens of a lamp has dirt particles deposited thereon, the dirt increases the opacity of the lens. The increase of the opacity causes a decrease of intensity of transmitted light from the lamp thereby making the light from the lamp difficult to see. Accordingly, the increase of the opacity is undesirable.

Usually, a traffic signal lamp assembly is mounted above the ground at a level which is not easily reached. Therefore, when lenses of the lamp assembly have the increased opacity due to dirt, the lenses are not cleaned. It should be appreciated that when the increased opacity decreases the intensity of light from the lamp assembly, motorists and pedestrians are endangered.

Accordingly, there is a need for a traffic signal lamp assembly having lenses which are cleaned automatically.

SUMMARY OF THE INVENTION

According to the present invention, in a traffic signal lamp assembly where a lamp transmits through a lens light which passes through a cylindrical hood, extending through said hood is an outlet port of a trough having an inlet port disposed above the hood whereby a liquid entering the inlet port flows through the outlet port over the lens.

The present invention provides traffic lights having lenses which are automatically cleaned during a rain storm.

Other objects, features and advantages of the present invention will become more apparent in the light of the following description of a preferred embodiment thereof as illustrated in the accompanying drawing.

DESCRIPTION OF THE PREFERRED EMBODIMENT

In the present invention, rain water collected during a rainstorm is directed over a surface of a lens of a signal lamp, thereby cleaning the surface.

Figure 1:
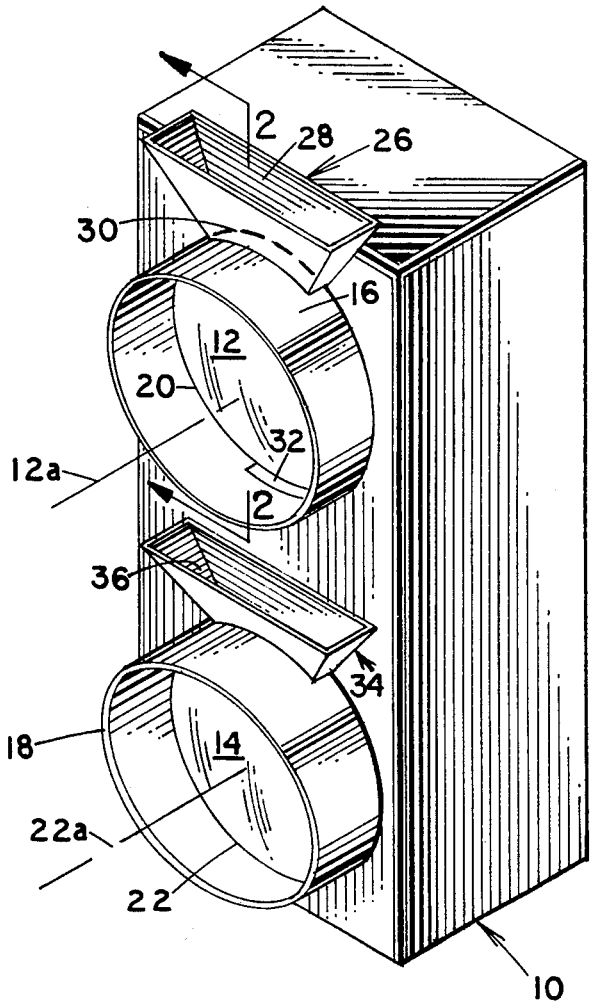
FIG. 1 is a perspective view of a preferred embodiment of the present invention.
Figure 2:
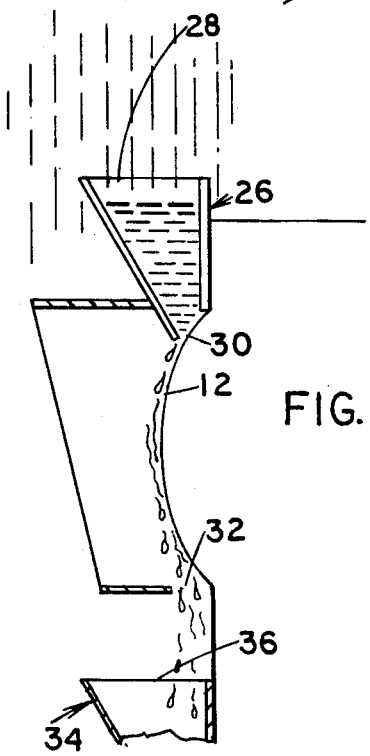
FIG. 2 is a partial section of a side elevation of the embodiment of FIG. 1.

Referring to FIG. 1 and FIG. 2, a traffic signal lamp assembly 10 has an upper lens 12 and a lower lens 14 through which light is transmitted. Typically, the lenses 12, 14 are tinted to transmit red and green light, respectively, therethrough.

Connected to the assembly 10 is a first cylindrical hood 16 and a second cylindrical hood 18 having ends 20, 22 which border edges of the lenses 12, 14, respectively, whereby a lens axis 12*a* of the lens 12 is substantially along the axis of the first hood 16 and a lens axis 14*a* of the lens 14 is substantially along the axis of the second hood 18. Therefore, light transmitted through the lens 12 passes through the first hood 16 and light transmitted from the lens 14 passes through the second hood 18. The hoods 16, 18, are provided to increase the visuability, during a bright day, of the light transmitted through the lenses 12, 14.

A top portion 28 of the first hood 16, adjacent to the assembly 10, is integral with a first trough 26 having an inlet port 28 where rain water is received during a rainstorm. Additionally, the first trough 26 has an outlet port 30 near the lens 12 which extends through the first hood 16. Accordingly, the rain water received through the inlet port 28 flows through the outlet port 30 and over the surface of the lens 12 thereby automatically cleaning the lens 12.

A bottom portion of the first hood 16 has a drain hole 32 therethrough whereby the rain water flows through the drain 32. Below the drain 32 is a second trough 34, similar to the first trough 26, having an inlet port 36 wherein the rain water is received. In a manner similar to that described hereinbefore, the rainwater automatically cleans the lens 14.

Although the invention has been shown and described with respect to a preferred embodiment thereof, it should be understood by those skilled in the art that various changes and omissions in the form and detail thereof may be made therein without departing from the spirit and scope of the invention.

Having thus described a typical embodiment of my invention, that which I claim as new and desire to secure by letters patent of the United States:

1. In a traffic signal lamp assembly of the type having a lamp which transmits through a lens light which passes through a cylindrical hood connected to said assembly with the axis of said hood substantially along a lens axis of said lens, the improvement comprising:

A trough connected to said hood next to said lens, an outlet port of said trough extending through said hood and an inlet port of said trough being above said hood whereby rain entering said inlet port flows over said lens.

2. The traffic signal assembly of claim 1 wherein, said hood has at the bottom thereof a drain hole whereby rain flows through said drain hole.

* * * * *